US008353516B2

(12) United States Patent
Collins et al.

(10) Patent No.: US 8,353,516 B2
(45) **Date of Patent: *Jan. 15, 2013**

(54) TRAVEL GAME

(75) Inventors: Gary Collins, Lawndale, CA (US); Stephen Lau, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/632,313

(22) Filed: Dec. 7, 2009

(65) Prior Publication Data

US 2010/0078887 A1 Apr. 1, 2010

Related U.S. Application Data

(63) Continuation of application No. 11/182,396, filed on Jul. 15, 2005, now Pat. No. 7,654,531.

(60) Provisional application No. 60/622,038, filed on Oct. 26, 2004.

(51) Int. Cl.
*A63F 3/00* (2006.01)

(52) U.S. Cl. ..... 273/285; 273/287

(58) Field of Classification Search ..... 273/285, 273/286, 287, 282.1, 283, 284
See application file for complete search history.

(56) References Cited

U.S. PATENT DOCUMENTS

| | | | | |
|---|---|---|---|---|
| 136,200 | A * | 2/1873 | Arms | 273/285 |
| 296,012 | A | 4/1884 | Jackson | |
| 603,186 | A | 4/1898 | Griffis | |
| 1,292,722 | A * | 1/1919 | De Lappe | 273/281 |
| 1,579,276 | A | 4/1926 | Birnberg | |
| 2,205,298 | A | 6/1940 | Lindner | |
| 2,544,594 | A | 3/1951 | Goldfarb | |
| 2,583,998 | A * | 1/1952 | Cook | 281/19.2 |
| 3,128,098 | A | 4/1964 | Kolenda | |
| 3,296,735 | A | 1/1967 | Djedda | |
| 3,578,320 | A | 5/1971 | Goldfarb et al. | |

(Continued)

FOREIGN PATENT DOCUMENTS

| | | |
|---|---|---|
| DE | 9411976 | 12/1994 |

(Continued)

OTHER PUBLICATIONS

K'NEX, K'NEX 2004 Catalogue, p. 4 (2004).

(Continued)

*Primary Examiner* — Vishu K. Mendiratta
(74) *Attorney, Agent, or Firm* — Panitch Schwarze Belisario & Nadel LLP

(57) ABSTRACT

A toy play set for containing at least one predetermined board game includes a generally elongated body having a hollow interior, first and second opposing longitudinal ends, and a generally curved side wall extending around the hollow interior between the first and second ends. The first and second ends and side wall generally surround the hollow interior in a closed configuration of the body. The body has an open configuration in which the hollow interior is at least partially accessible. A playing surface is operably engaged with the body and is configured to play the predetermined board game. The playing surface is shaped and sized to enable the playing surface to be completely stored within the hollow interior of the body with the body in the closed configuration. The playing surface is accessible at least with the body in the open configuration for playing of the predetermined board game.

18 Claims, 7 Drawing Sheets

U.S. PATENT DOCUMENTS 3,623,728 A * 11/1971 Goldfarb ..... 273/109
3,761,094 A 9/1973 Belisle
3,814,436 A 6/1974 Boren
4,032,141 A 6/1977 Tanimura et al.
4,103,774 A 8/1978 Shingyouchi et al.
4,261,576 A * 4/1981 Friedenthal ..... 273/285
4,275,887 A * 6/1981 Tateyama ..... 273/239
4,371,168 A 2/1983 Dupuis
4,408,763 A * 10/1983 Simons ..... 273/286
4,433,504 A 2/1984 Terui et al.
4,513,974 A * 4/1985 Lin ..... 273/239
4,581,904 A 4/1986 Lehmann et al.
4,923,429 A 5/1990 Lewis
4,946,413 A 8/1990 Lehmann et al.
4,964,831 A 10/1990 Wolff
4,966,277 A 10/1990 Razzore
5,029,700 A 7/1991 Chen
5,035,324 A 7/1991 Bertrand et al.
5,074,561 A 12/1991 Johnson
5,145,185 A * 9/1992 Yu et al. ..... 273/287
5,167,564 A 12/1992 Lord
5,197,735 A 3/1993 Land et al.
5,209,345 A 5/1993 Haugabook
5,224,894 A 7/1993 Nelson et al.
5,261,848 A 11/1993 Kaplan et al.
5,356,155 A * 10/1994 Gross ..... 273/284
5,375,828 A 12/1994 Shikami
5,419,436 A 5/1995 Powell
5,540,611 A 7/1996 Lapoint et al.
5,803,306 A 9/1998 Lewis
5,897,418 A 4/1999 Spector
5,957,275 A * 9/1999 Lemaire ..... 206/83
5,996,781 A 12/1999 Glaser et al.
6,098,794 A 8/2000 Lin et al.
6,117,502 A 9/2000 Liao et al.
6,120,295 A 9/2000 Pracas et al.
6,146,721 A 11/2000 Freynet et al.
6,203,393 B1 3/2001 Flynn et al.
6,247,729 B1 6/2001 Kaufman
6,367,799 B1 4/2002 Sippel et al.
6,506,094 B1 1/2003 Chang et al.
6,575,807 B2 6/2003 Spector
6,652,024 B2 11/2003 Prasatek
6,719,606 B1 4/2004 Mukensturm
6,752,679 B1 6/2004 Lui et al.
7,285,034 B2 * 10/2007 Kay et al. ..... 446/73
2002/0039609 A1 4/2002 Bezek et al.
2002/0182974 A1 12/2002 Grabianski
2004/0203317 A1 10/2004 Small
2005/0012274 A1 1/2005 Ritter et al.
2005/0017452 A1 1/2005 Stein

FOREIGN PATENT DOCUMENTS

GB 2218643 A * 11/1989

OTHER PUBLICATIONS

Supplementary European Search Report Issued Dec. 3, 2007 in EP Application No. 05816293.4 (total 7 pages).

* cited by examiner

TRAVEL GAME

CROSS-REFERENCE TO RELATED APPLICATIONS

This patent application is a continuation of U.S. Non-Provisional Patent Application No.: 11/182,396 filed Jul. 15, 2005, entitled "Travel Game". This application further claims priority to U.S. Provisional Patent Application No. 60/622,038, filed Oct. 26, 2004, entitled "Travel Game", the disclosure of which is incorporated herein by reference.

BACKGROUND OF THE INVENTION

This invention generally relates to game sets and, more particularly, to a game set for containing and playing a game, such as a board game. It is known to provide game sets for use traveling. It is believed that a board game set adapted for travel use would be desirable.

BRIEF SUMMARY OF THE INVENTION

Briefly stated, the present invention is a toy play set for containing at least one predetermined board game. The toy play set comprises a generally elongated body having a hollow interior, first and second opposing longitudinal ends, and a generally curved side wall extending around the hollow interior between the first and second ends. The first and second ends and side wall generally surround the hollow interior in a closed configuration of the body. The body has an open configuration in which the hollow interior is at least partially accessible. A playing surface is operably engaged with the body and is configured to play the predetermined board game. The playing surface is shaped and sized to enable the playing surface to be completely stored within the hollow interior of the body with the body in the closed configuration. The playing surface is accessible at least with the body in the open configuration for playing of the predetermined board game.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
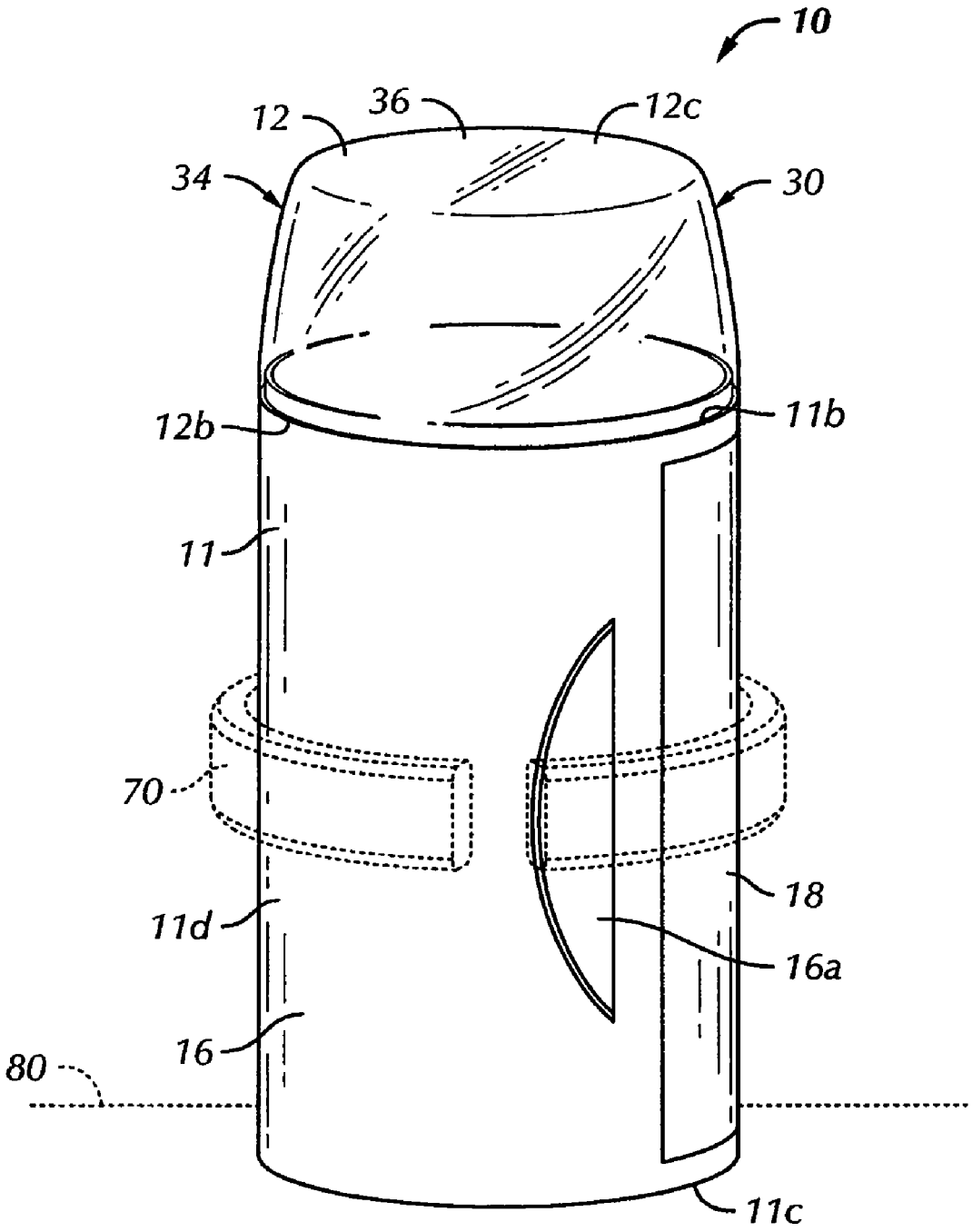
FIG. 1 is a side perspective view of a toy play set in the form of a board game set in accordance with a first preferred embodiment of the present invention, the game set in a closed configuration.

Certain terminology is used in the following description for convenience only and is not limiting. The words "right," "left," "upper," and "lower" designate directions in the drawings to which reference is made. The terminology includes the words above specifically mentioned, derivatives thereof, and words of similar import.

Referring to the drawings in detail, wherein like numerals indicate like elements throughout, there is shown in FIGS. 1-5 a first preferred embodiment of a toy play set or "game set", indicated generally at 10, in accordance with the present invention. The toy play set 10 is intended to be used while traveling, preferably while traveling in vehicles (not shown) with beverage cup holder 70. As such, the toy play set 10 is appropriately sized to fit in a standard beverage cup holder 70 of an automobile (not shown) or other such cup holder bearing vehicle (not shown). The toy play set 10 preferable contains at least one predetermined board game, as will be described below.

Referring to FIG. 1-4, the toy play set 10, when in a closed configuration 30 (FIG. 1), is preferably essentially in the form of a generally cylindrical canister, including a lid 12 that releasably engages with a generally elongated body 11, such that the toy play set 10 is generally shell-like and at least partially hollow. The body 11 preferably has a hollow interior 11*a*, first and second opposing longitudinal ends 11*b*, 11*c*, and a generally curved side wall 11*d* extending around the hollow interior between the first and second ends 11*b*, 11*c*. The first and second ends 11*b*, 11*c* and the side wall 11*d* preferably generally surround the hollow interior 11*a* when the body 11 is in the closed configuration 30. In an open configuration 32 (FIGS. 2-4), the hollow interior 11*a* of the body 11 is at least partially accessible to a user.

Preferably, at least one of the first and second longitudinal ends 11*b*, 11*c* of the body 11 is sized and shaped to fit at least partially into the beverage cup holder 70 of a vehicle sufficiently for the cup holder 70 to support the body 11 in a generally upright orientation 34 with the other of the first and second ends 11*b*, 11*c* forming a top end 36 of the body 11 with the body 11 in the closed configuration 30. It is further preferred that at least one of the first and second ends 11*b*, 11*c* is sufficiently flat to support the body 11 in the generally upright orientation 34 with the other of the first and second ends 11*b*, 11*c* forming the top end 36 of the body 11. In this way, when not in use, the toy play set 10 can be retained in the upright orientation 34 within the vehicle to lessen the likelihood of the toy play set 10 tipping over, falling, rolling, or otherwise moving with respect to the vehicle during movement of the vehicle.

The lid 12 is preferably removably engageable with at least one of the first and second ends 11*b*, 11*c* of the body 11 in at least the closed configuration 30. The lid 12 is preferably generally cup-shaped with an open end 12*b* and an oppositely disposed closed end 12*c*. A cavity 12*a* is defined within the lid 12 and is accessible though the open end 12*b*. The open end 12*b* of the lid 12 preferably releasably interlocks with at least one of the first and second ends 11*b*, 11*c* of the body 11, e.g., by suitable means such as, but not limited to, tongue and groove, mating threads, bayonet connectors, etc. When in the closed configuration 30, the body 11 preferably contains all of the below-described game materials within. Although this configuration is preferred, it is within the spirit and scope of the present invention that at least some of the below-described game materials be held within the cavity 12*a* of the lid 12. For instance, instructions to the board game of the toy play set 10 can be stored within the cavity 12*a* of the lid 12, or, for other types of board games (e.g., checkers, chess, and backgammon, etc.), game pieces can be stored therein.

It is preferred that the lid 12, when engaged with one of the first and second ends 11*b*, 11*c*, is sized and shaped to fit at least partially within the beverage cup holder 70 of a vehicle sufficiently for the cup holder 70 to support the toy play set 10 in a generally upright orientation 34 with the other of the first and second ends 11*b*, 11*c* forming a top end of the toy play set 10. Specifically, the lid 12 preferably is tapered and sized to be received in the vehicle beverage cup holder 70 for storage. In this way, when not in use, the toy play set 10 can be retained in the upright orientation 34 within the vehicle to lessen the likelihood of the toy play set 10 tipping over, falling, rolling, or otherwise moving with respect to the vehicle during movement of the vehicle. Additionally, it is preferred that the closed end 12*c* of the lid 12 is sufficiently flat to support the toy play set 10 in the generally upright orientation 34 on a substantially flat surface 80.

Figure 2:
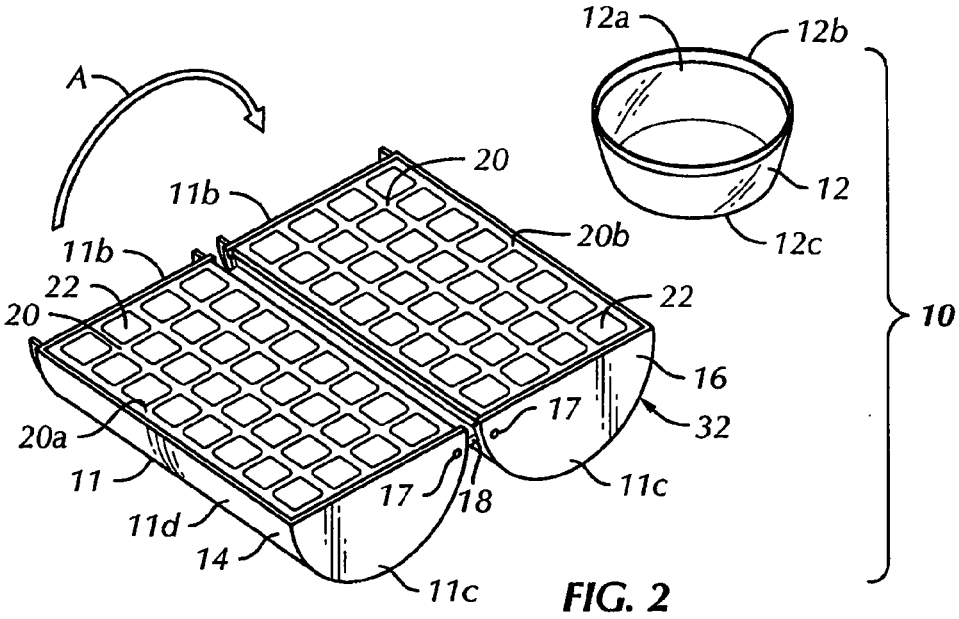
FIG. 2 is a top perspective view of the game set of FIG. 1 in an open configuration.
Figure 3:
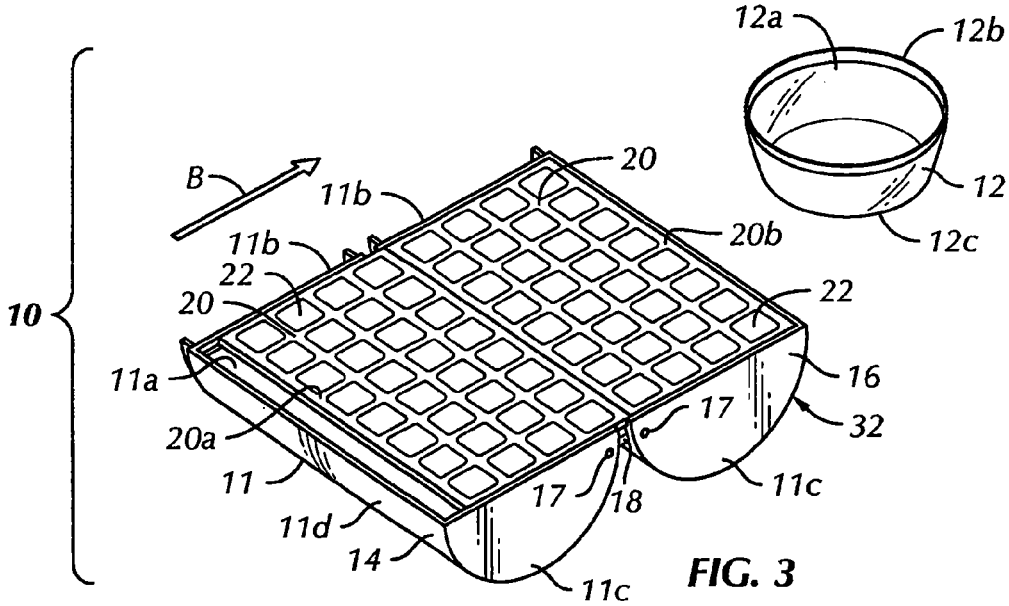
FIG. 3 is a top perspective view of the game set of FIG. 2.

Referring to FIGS. 1-3, the body 11 preferably has first and second portions 14, 16, although it is contemplated that the body 11 have more or less than two portions, provided it can still function as described herein. Preferably, the body 11 is divided along a central plane extending longitudinally between the first and second ends 11*b*, 11*c* of the body 11, such that the first and second portions 14, 16 each form substantially half of the body 11. The first and second portions 14, 16 preferably are identical halves of the body 11, each of which is generally semicircular when viewed from above or below. At least one hinge 17 pivotably engages the first and second portions 14, 16. Specifically, the first and second portions 14, 16 are pivotably attached to one another to rotate with respect to each other, such that the first and second portions 14, 16 can be opened by rotating one of the first and second portions 14, 16 with respect to the other of first and second portions 14, 16 along arrow A (FIG. 2).

Preferably, the first and second portions 14, 16 are attached using a double-hinge configuration, such that each of the first and second portions 14, 16 is pivotably attached to opposite axial sides of an intermediate portion 18 via hinges 17. That is, one of the first and second portions 14, 16 is attached to one side of the intermediate portion 18, and the other of the first and second portions 14, 16 is attached to an oppositely disposed side of the intermediate portion 18, with both of the first and second portions 14, 16 pivoting along pivot axes generally parallel to the axial direction of the body 11. In this way, the body 11 can be opened to form a substantially flat top surface without having hinges or other pivotable attachment structures exposed in the top surface. That is, the hinges 17 preferably are disposed below the top surface of the toy play set 10 and do not interfere therewith, as seen specifically in FIGS. 2 and 3. Although this hinged configuration is preferred, it is within the spirit and scope of the present invention that the first and second portions 14, 16 be attached in a different manner provided the toy play set 10 is still capable of functioning as described herein.

Referring to FIGS. 2 and 3, preferably, a playing surface 20 is operably engaged with the body 11 and configured to play the predetermined board game. The playing surface 20 is generally shaped and sized to enable the playing surface 20 to be completely stored within the hollow interior 11*a* of the body 11, when in the closed configuration 30. The playing surface 20 is accessible at least with the body 11 in the open configuration 32 for playing of the predetermined board game.

Specifically, it is preferred that the playing surface 20 be divided into two, preferably identical sides 20*a*, 20*b*. Each of the first and second portions 14, 16 have one of the first or second sides 20*a*, 20*b* of the playing surface 20 engaged therewith, such that, when the first and second portions 14, 16 are opened, the first and second sides 20*a*, 20*b* of the playing surface 20 are substantially aligned within the same plane to form the top surface of the toy play set 10.

Referring specifically to FIG. 3, preferably, the first side 20*a* of the playing surface 20 is engaged with the first portion 14 of the body 11 and the second side 20*b* is engaged with the second portion 16 of the body 11, wherein at least one of the first and second sides 20*a*, 20*b* is slidable such that the at least one of the first and second sides 20*a*, 20*b* can be slid toward the other of the first and second sides 20*a*, 20*b* of the playing surface 20 in order to form a continuous top surface of the toy play set 10 with the body 11 in the open configuration 32. Preferably, the first side 20*a* slides with respect to the first portion 14 of the body 11 along arrow B to abut the second side 20*b* of the playing surface 20. Although this configuration is preferred, it is within the spirit and scope of the present invention that the second side 20*b* of the playing surface 20 be slidable with respect to the second portion 16 of the body 11 or that both sides 20*a*, 20*b* be slidably engaged with the first and second portions 14, 16, respectively, as is described below with respect to a second preferred embodiment.

Figure 5:
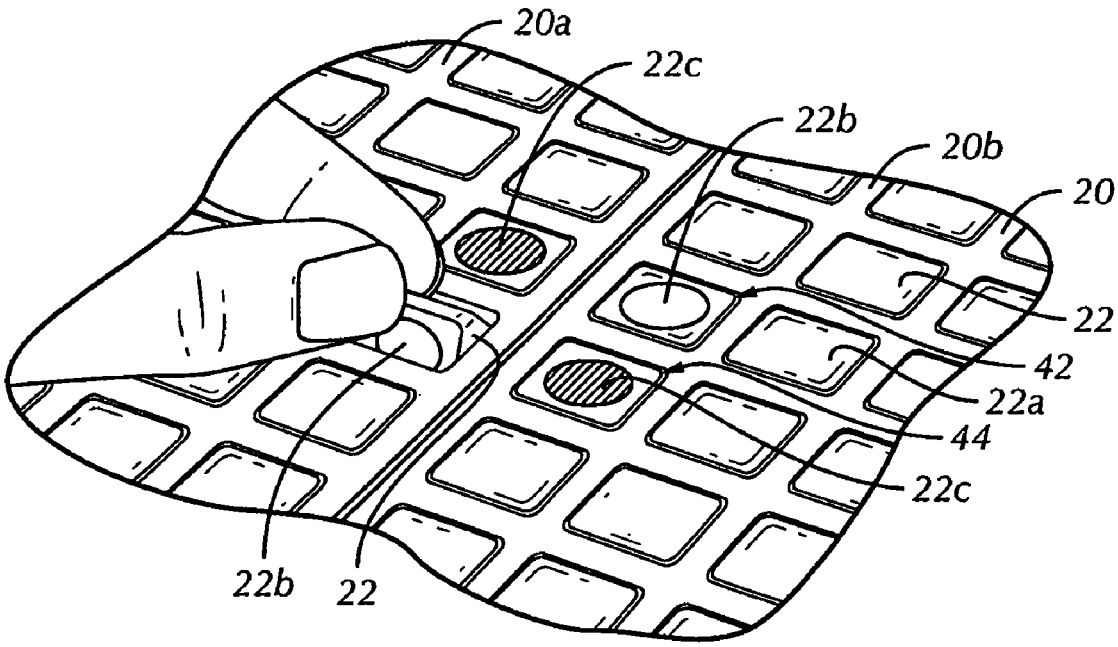
FIG. 5 is an enlarged top perspective view of game pieces of the game sets of FIG. 3.

According to another aspect of the invention, a plurality of game pieces are selected for use with the playing surface 20, the plurality of game pieces being sized to store with the playing surface 20 in the hollow interior 11*a* of the body 11 in the closed configuration 30. Referring to FIGS. 2, 3, and 5, preferably, the first and second sides 20*a*, 20*b* of the playing surface 20 have a grid-like pattern of a plurality of generally square-shaped game pieces 22, when viewed from above. In actuality, when viewed separate from the playing surface 20, each game piece 22 is in the shape of a triangular prism having five faces with three generally square faces and two generally triangular faces. The game pieces 22 are for use with the playing surface 20 when playing the predetermined board game. Preferably, the game pieces 22 are stored with the playing surface 20 in the hollow interior 11*a* of the body 11 in the closed configuration 30. The game pieces 22 are preferably rotatably engaged with the playing surface 20, such that the game pieces 22 are rotatable to alternately selectively expose the three square faces at a top of the playing surface 20. Although the playing surface 20 of the first embodiment toy play set 10 includes sixty-four game pieces 22, it is contemplated that the playing surface have more or less than sixty-four game pieces 22.

Each game piece 22 has at least one indicium thereon so that rotation of the game piece 22 to a first orientation 42 presents the at least one indicium. It is preferred that each game piece 22 has a second indicium thereon, which is presented when the game piece 22 is rotated to a second orientation 44. Preferably, one square face has no indicia or markers, thereby forming a blank face 22*a*. The other two square faces preferably have indicia or markers 22*b*, 22*c* of different colors thereon. Preferably, the markers 22*b*, 22*c* are stickers and are of contrasting colors, such as white and black, for instance, so that the different markers 22*b*, 22*c* are readily distinguishable. Although it is preferred that the markers 22*b*, 22*c* are white and black stickers, it is within the spirit and scope of the present invention that the markers 22*b*, 22*c* take a different form, such as being painted onto the game pieces 22 or etched or molded into the game pieces 22, for instance. It is further contemplated that the markers 22*b*, 22*c* be of colors other than white and black.

The game pieces 22 are preferably rotatable about shafts (not shown, but similar to shafts 124 discussed below with respect to the second embodiment and shown in FIG. 7) extending through the first and second sides 20*a*, 20*b* of the playing surface 20, with the shafts extending through the centers of the triangular faces of each of the game pieces 22. In this way, the game pieces 22 can be selectively rotated to expose any one of the three square faces of the game pieces 22. Specifically, the game pieces 22 can be rotated to alternately expose one of the blank face 22*a*, the white marker 22*b*, and the black marker 22*c*. Preferably, each of the game pieces 22 have detents (not shown) which interact with the playing surface 20 to allow the game pieces 22 to be retained with the desired one of the blank face 22*a*, the white marker 22*b*, and the black marker 22*c* exposed.

Figure 4:
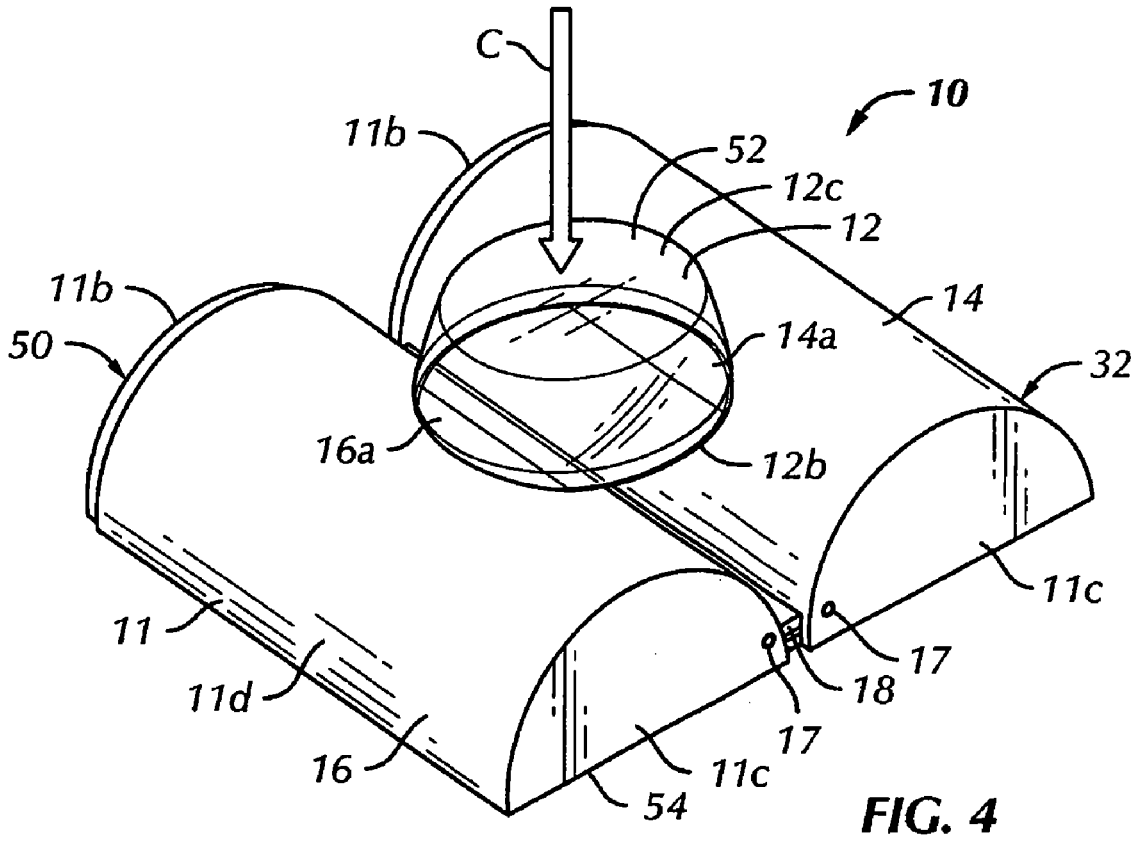
FIG. 4 is a bottom perspective view of the game set of FIG. 2.

Referring to FIG. 4, each of the first and second portions 14, 16 of the body 11 preferably has a small arcuate indentation 14*a*, 16*a* disposed in a side wall thereof. Preferably, the indentations 14*a*, 16*a* are disposed generally halfway between top and bottom sides of the first and second portions 14, 16 proximate the intermediate portion 18. In this way, when the first and second portions 14, 16 are opened, the indentations 18 are disposed in the underside of the body 11. When in the open configuration 32, the lid 12 can be inserted along arrow C into engagement with the indentations 18 of the first and second portions 14, 16 of the body 11, releasably locking the first and second portions 14, 16 together to keep them from flexing and folding together. Preferably, the lid 12 engages with the body 11, such that the open end 12*b* of the lid 12 is proximate, and preferably abutting, the body 11 and the closed end 12*c* of the lid 12 extends outwardly from the body 11 in a direction generally opposite from the playing surface 20. In this way, when the toy play set 10 is in a generally upright play orientation 50, the lid 12 forms a base 52 of the toy play set 10 and the playing surface 20 forms a top 54 of the toy play set 10 to enable playing of the predetermined board game. Because, as described above, the closed end 12*c* of the lid 12 is preferably generally flat, the toy play set 10 can be supported in the generally upright play orientation 50 on a substantially flat surface 80. Moreover, the lid 12 extends outwardly from the body 11 in the open configuration 32 to enable the lid 12 to be placed within the cup holder 70 sufficiently to support the toy play set 10 in the generally upright play orientation 50, if so desired.

Figure 6:
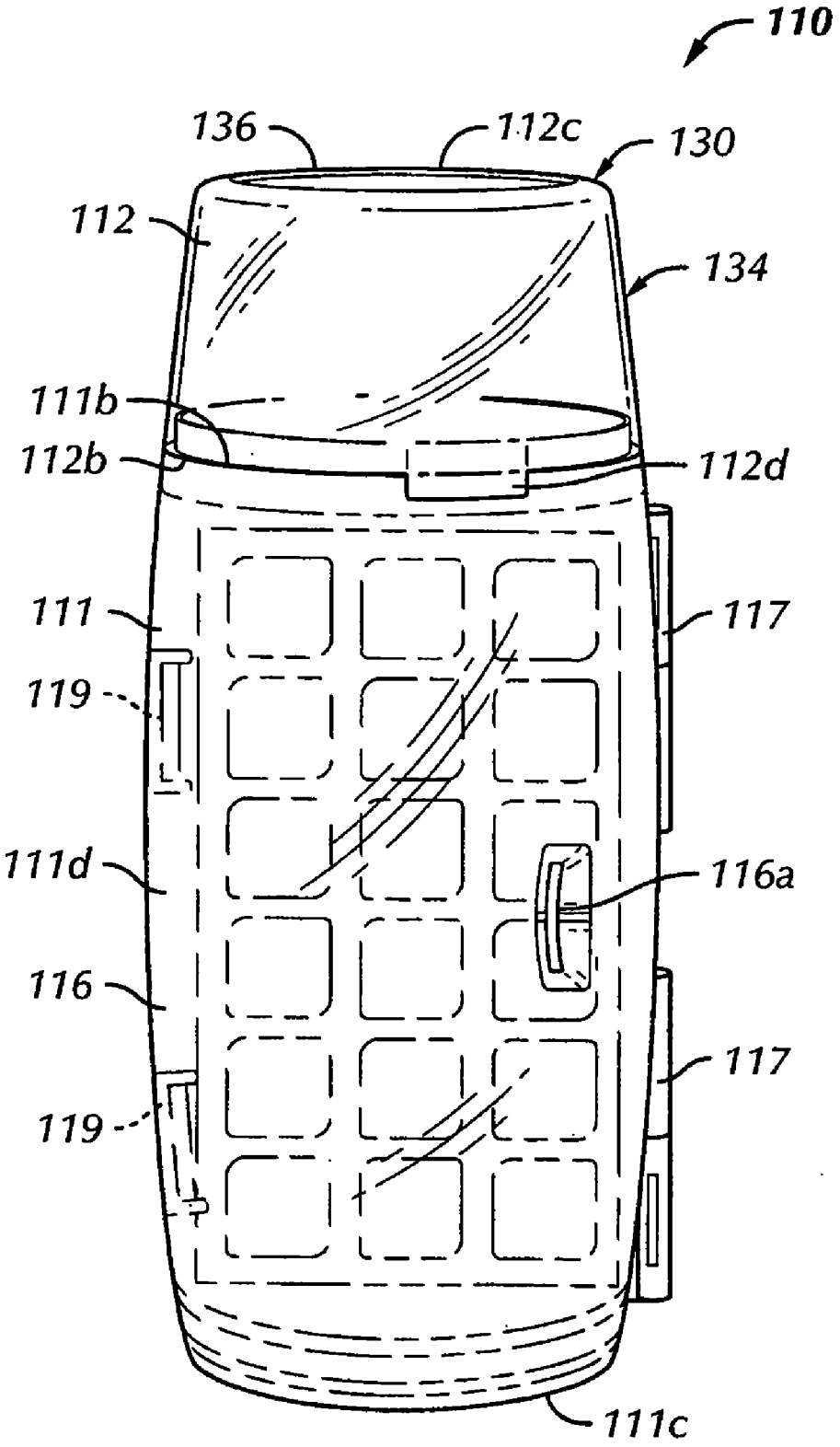
FIG. 6 is a side perspective view of a toy play set in the form of a board game set in accordance with a second preferred embodiment of the present invention, the game set in a closed configuration.
Figure 7:
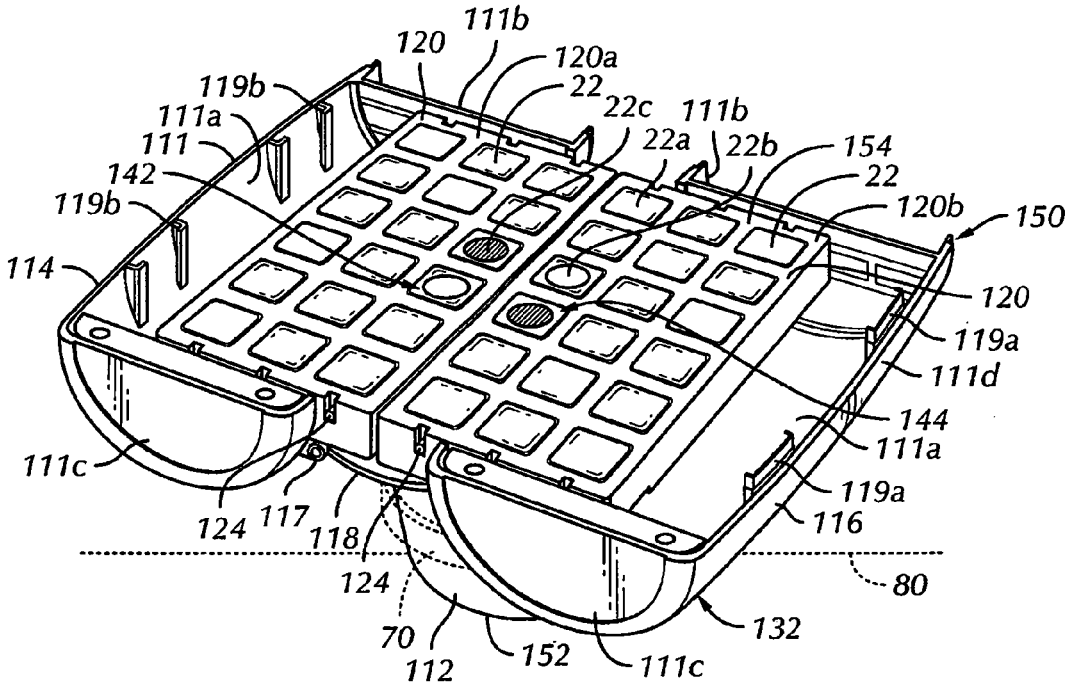
FIG. 7 is a top perspective view of the game set of FIG. 6 in an open configuration.
Figure 8:
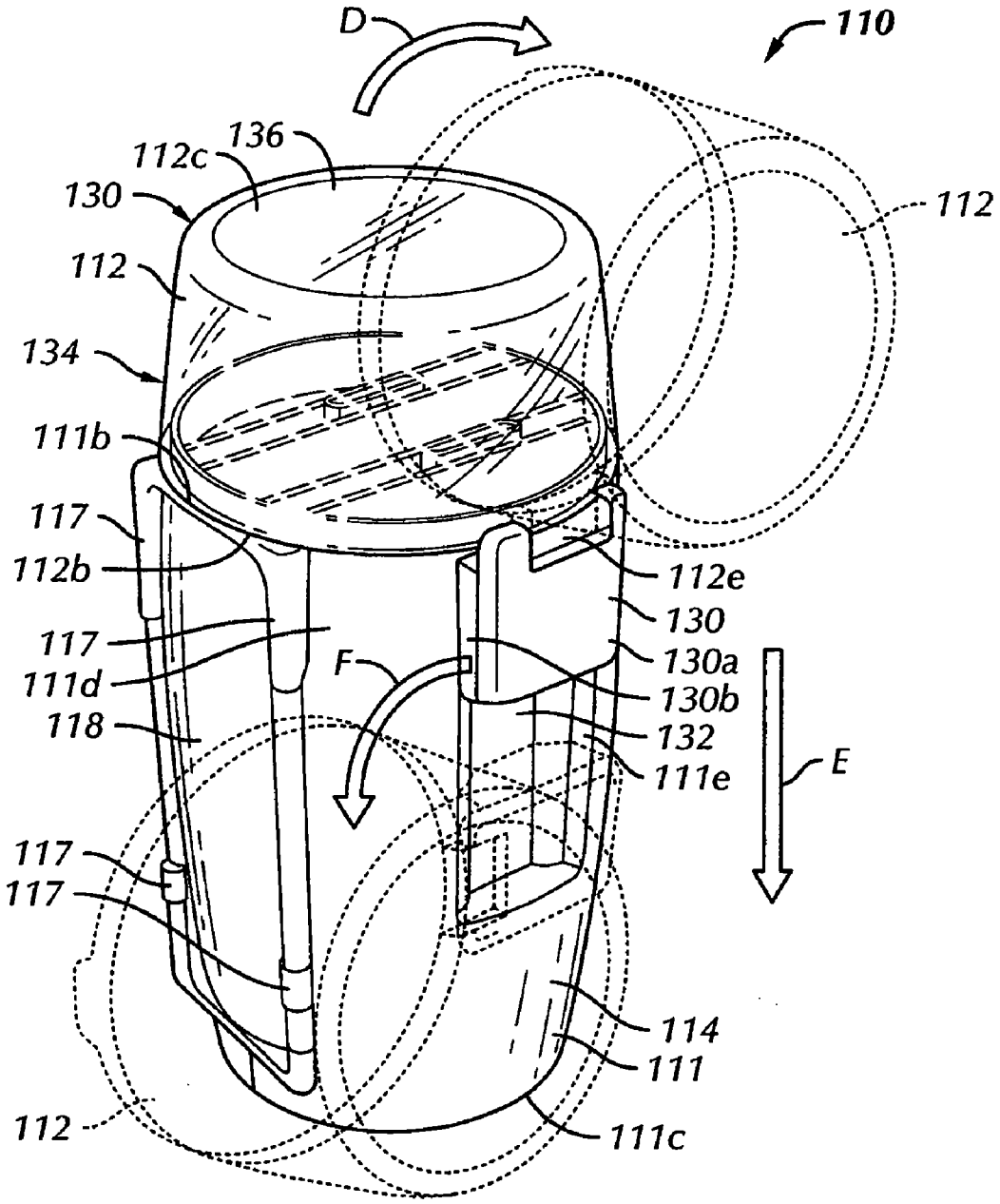
FIG. 8 is a side perspective view of the game set of FIG. 6 showing various positions of the lid.

With reference now to FIGS. 6-8, a second embodiment toy play set 110 is constructed and operated generally similarly to the first embodiment toy play set 10. In general, elements of the second embodiment play set 110 are assigned reference numbers incremented by 100 above corresponding elements of the first embodiment play set 10. For example, an element of the second embodiment play set 110 corresponding to the body 11 of the first embodiment is assigned a reference number of 111. As the structure and operation of the second embodiment play set 110 are generally similar to the structure and operation of the first embodiment play set 10, it is not necessary to describe the additional second embodiment play set 110 in further detail except to point out a few notable differences, as discussed below.

The main difference between the second embodiment toy play set 110 and the first embodiment toy play set 10 is that first and second sides 120*a*, 120*b* of a playing surface 120 are each slidable with respect to respective first and second portions 114, 116 of a body 111 to which the first and second sides 120*a*, 120*b* are engaged, as opposed to the configuration of the first embodiment toy play set 10 in which only one of the first and second sides 20*a*, 20*b* of the playing surface 20 is slidable. That is, preferably, the first side 120*a* of the playing surface 120 is slidably engaged with the first portion 114 of the body 111, and the second side 120*b* of the playing surface 120 is slidably engaged with the second portion 116 of the body 111, with each of the first and second sides 120*a*, 120*b* of the playing surface 120 being generally parallel to a central plane of the body 111. In this way, each of the first and second sides 120*a*, 120*b* slides toward a center of the toy play set 110 in order for the first and second sides 120*a*, 120*b* of the playing surface 120 to abut each other when the body 111 is in an open configuration 132, as shown in FIG. 7.

Referring specifically to FIG. 8, a lid 112 of the toy play set 110 also differs from that of the first embodiment toy play set 10. Although the lid 112 is similar to the lid 12 of the first embodiment in that it is preferably removably engageable with a first end 111*b* of the body 111, it is preferable that the lid 112 remain engaged with a side wall 111*d* of the body 111. Specifically, it is preferable that the lid 112 be rotatably and slidably engaged with the side wall 111*d*. This is preferably accomplished with a slider 130 slidable along a track 132 mounted within an opening or slot 111*e* in the side wall 111*d* of the body 111, preferably within the first portion 114 of the body 111. The slider 130 preferably includes a lid mount 130*a* and a base 130*b* that is slidably retained on the track 132. The lid mount 130*a* is preferably rotatably mounted to the base 130*b*. The lid 112 is preferably pivotably mounted to the lid mount 130*b* via a hinge 112*e*.

Referring still to FIG. 8, the lid 112 can be removed from engagement with the first end 111*b* of the body 111 by pivoting the lid 112 about the hinge 112*e* (along arrow D) to enable the body 111 to be placed in the open configuration 132. The lid 112, however, remains attached to the toy play set 110 to reduce the likelihood of misplacing or otherwise losing the lid 112. The lid 112 and slider 130 can then be moved along the track 132 (along arrow E) within the slot 111*e* in the side wall 111*d* of the body 111. The lid 112 and lid mount 130*a* can then be rotated (along arrow F) with respect to the base 130*b* of the slider 130 to place the lid 112 in position to form a base 152 of the toy play set 110 (in a similar manner to that described above with respect to the first embodiment) when in a generally upright play orientation 150. It is preferable that the lid 112 include a tab 112*d* for engagement within a slot 116*a* (see FIG. 6) in the second portion 116 of the body 111 when the body 111 is in the open configuration 132. By engaging the tab 112*d* within the slot 116*a*, the lid 112 is fixed to both the first and second portions 114, 116 of the body 111 and acts to keep the first and second portions 114, 116 from flexing and folding together. Moreover, as with the first embodiment, the lid 112 extends outwardly from the body 111 in the open configuration 132 to enable the lid 112 to be placed within the cup holder 70 (see FIG. 7) sufficiently to support the toy play set 110 in the generally upright play orientation 150, if so desired.

An additional difference is that the playing surface 120 of the second embodiment toy play set 110 is shown with thirty-six game pieces 22, rather than sixty-four, as was shown with respect to the first embodiment toy play set 10. As was stated above, the number of game pieces 22 can vary within the spirit and scope of the present invention. The main limiting factors for the number of game pieces 22 is the intended overall size of the toy play set 110 and the desired size of the game pieces 22 associated therewith.

Referring to FIGS. 6 and 7, preferably, the first and second portions 114, 116 of the body 111 are interlocked when in a closed configuration 130 using at least one latch 119. The latch 119 preferably has a tab 119*a* extending circumferentially from an inner surface of one of the first and second portions 114, 116, which mates within a corresponding slot 119*b* in an inner surface of the other of the first and second portions 114, 116. Although it is preferable that the latch 119 generally be of a tongue and groove configuration, it is within the spirit and scope of the present invention that the latch 119 have a different structure, such as that of a bayonet connector, for instance. Also, it is preferable that the body 111 have two latches 119, as shown in FIG. 7, although it is within the spirit and scope of the present invention that there be more or less than two latches 119.

Referring to FIGS. 1-8, the toy play set 10, 110 is stored in the closed configuration 30, 130 (FIGS. 1 and 6), and can be placed in the open configuration 32, 132 (FIGS. 2 and 7). When in the open configuration 32, 132, the lid 12, 112 is separated from the body 11 for the first embodiment or rotated out of engagement with the body 111 about the hinge 112*e* for the second embodiment. The first and second portions 14, 16, 114, 116 are opened, and the first and second sides 20*a*, 20*b*, 120*a*, 120*b* of the playing surface 20, 120 are pushed together (FIGS. 3 and 7). The lid 12 of the first embodiment is inserted within the indentations 14*a*, 16*a* of the first and second portions 14, 16, respectively, to stabilize the first and second portions 14, 16 of the body 11 (FIG. 4). Alternatively, the lid 112 of the second embodiment, mounted on the slider 130, is moved along the track 132 and rotated to enable the tab 112*d* of the lid 112 to engage with the slot 116*a* of the second portion 116 of body 111. By doing so, the first and second portions 14, 16, 114, 116 are essentially locked, thereby reducing the amount of flexing and movement of the toy play set 10, 110 during use. Preferably, the lid 12, 112 and the body 11, 111 (when in the closed configuration 30, 130) are shaped and sized to be retained in cup holders 70.

In this way, the toy play set 10, 110, when in the closed configuration 30, 130 and not in use, can be at least partially inserted within the cup holder 70 to prevent it from moving around the vehicle. When the toy play set 10, 110 is in the open configuration 32, 132, the lid 12, 112 extends downwardly from the bottom of the open body 11, 111 and can be inserted within the cup holder 70 in order to prevent the toy play set 10, 110 from moving around the vehicle during play. Alternatively, the toy play set 10, 110, when in the open configuration 32, 132, can be placed on a substantially flat surface 80 during play with the closed end 12*c*, 112*c* of the lid 12, 112 acting as a base 52, 152.

The structural elements of the toy play set 10, 110 are preferably fabricated from conventional polymeric materials, such as polypropylene. Preferably, the polypropylene is semi-translucent so as to allow one to see through at least the body 11, 111 in order to at least partially see the contents within the body 11, 111. Although this is preferred, it is within the spirit and scope of the present invention that the structural elements of the toy play set 10, 110 be made of a different material, so long as the toy play set 10, 110 is capable of performing in the manner described herein.

In use, when in the closed position, the toy play set 10, 110 stores all of the above-described components of the toy play set 10, 110 within at least the body 11, 111, and potentially also within the cavity 12*a*, 112*a* of the lid 12, 112. When the predetermined board game of the toy play set 10, 110 is desired to be played, the body 11, 111 is opened, as described above. Users then take turns rotating the game pieces 22 to expose the appropriate white or black markers 22*b*, 22*c*.

More specifically, the at least one predetermined board game is played by two users alternately positioning game pieces 22 on the playing surface 20, 120. One user positions game pieces 22 so that the black marker 22*c* is exposed and the other user positions game pieces 22 so that the white marker 22*b* is exposed. Each user positions game pieces 22 to sandwich at least one of the other user's game pieces 22. The sandwiched game pieces 22 are then repositioned to expose the side of the color corresponding to the user who sandwiched the game pieces 22. The at least one predetermined board game ends when neither user is able to sandwich any of the other user's game pieces 22. The user with the most game pieces 22 positioned to expose the user's color is the winner of the at least one predetermined board game. Preferably, the predetermined board game of the toy play set 10, 110 is Othello®, the general rules of which are set forth above. However, the toy play set 10, 110 of the present invention is not intended to be limited to the playing of Othello®, as it is within the spirit and scope of the present invention that the toy play set 10, 110 be used for the playing of other board games.

When the game is completed or when the users otherwise tire of playing the predetermined board game, the body 11, 111 of the toy play set 10, 110 can be placed back into the closed configuration 30, 130 for storage of the toy play set 10, 110. In this way, the toy play set 10, 110 is generally self contained with a greatly decreased chance of losing components of the predetermined board game within the vehicle.

It will be appreciated by those skilled in the art that changes could be made to the embodiments described above without departing from the broad inventive concept thereof. For example, instead of the game pieces being integral with the board, they can be made removable and configured to be held in place on the board by suitable means such as magnets, fabric fasteners ("Velcro"), posts and mating holes, or wells configured to loosely receive or closely (i.e., matingly or telescopically) receive the game pieces, for instance. Also, game pieces can be made to be releasably secured to one side of a rotatably mounted game element like the game piece 22.

Although the above-described embodiments of the present invention are described and portrayed for playing the game Othello®, the embodiments are not intended to be so limited. Many, if not most, known board games can be adapted to the present invention by the provision of appropriate game pieces and a playing surface bearing appropriate board indicia and adapted to closely or loosely receive such pieces. For instance, since the playing surface 20 of the first embodiment preferably forms an eight by eight grid of game pieces 22, it is particularly well-suited to playing checkers by arranging the game pieces 22 in a checkerboard pattern with each player using differently colored markers 22*b*, 22*c*. It is further contemplated that the game pieces 22 have markers 22*b*, 22*c* of different colors than black and white, such as black and red, for instance, as is commonly associated with the game of checkers.

Additionally, it is contemplated that the present invention could be used to play a matching game such as the game commonly referred to as Concentration®, wherein the game pieces 22 each include one of various indicia. Each specific indicium would occur in a pair, such that two and only two game pieces would include the specific indicium, with thirty-two total pairs of indicia for the eight by eight playing surface 20 of the first embodiment and eighteen total pairs of indicia for the six by six playing surface 120 of the second embodiment. Players could then take turns trying to match pairs with the winner being the player who matched the most pairs. The game pieces could be retained within the playing surface 20, 120 as described above, such that the pairs of indicia are in a permanent, predetermined order. However, this configuration could result in the players tiring of the game after playing it enough times to memorize where the particular pairs are located. Therefore, it is further contemplated that the game pieces be easily removable from the playing surface 20 to allow the players to reconfigure the game pieces in order to vary the game. For instance, this could be accomplished by disposing the game pieces within slots accessible from the top of the playing surface 20 to allow the game pieces to be rotated in much the same way as described-above, while, at the same time, allowing the game pieces to be lifted upwardly from the playing surface 20 in order to reconfigure them. The game pieces can be provided with labels and an adhesive having a relatively low tack applied to one of the faces of the rotatable game pieces 22 or the rear side of the labels, allowing the labels to removably adhere to the rotatable game pieces 22. It is noted, however, that these are only a few of many possible ways of making the game pieces reconfigurable which are contemplated by the present invention.

Again, it is stressed that, while certain board games were specifically discussed above, the toy play set 10, 110 of the present invention could be configured to play many other board games not specifically discussed. It is understood, therefore, that this invention is not limited to the particular embodiments disclosed, but it is intended to cover modifications within the spirit and scope of the present invention.

We claim:

1. A toy play set for containing at least one predetermined board game, the toy play set comprising:

a generally circular cylindrically shaped, elongated body having a hollow interior, first and second opposing longitudinal ends, a central axis extending through the body between the longitudinal ends and a generally cylindrically shaped curved side wall extending around the hollow interior and the central axis elongatedly between the first and second ends, whereby the first and second ends and side wall generally surround the hollow interior in a closed configuration of the body, the generally cylindrically shaped curved side wall being generally circular in shape in planes perpendicular to the central axis, the body having an open configuration in which the hollow interior is at least partially accessible; and a playing surface operably engaged with the body to play the predetermined board game, the playing surface being shaped and sized to be completely stored within the hollow interior of the body with the body in the closed configuration, the playing surface being accessible at least with the body in the open configuration for playing of the predetermined board game;

wherein the body has a first portion and a second portion hinged together with the first portion, a generally planar first side of the playing surface is directly slidably engaged with only the first portion of the first and second portions of the body and a generally planar second side of the playing surface is directly slidably engaged with only the second portion of the first and second portions of the body;

wherein the first and second portions of the body rotate with respect to each other about adjoining hinged edges to place the body in the open configuration, such that outer surfaces of the first and second portions form a bottom side of the play set and the first and second sides of the playing surface form a top side of the play set; and further comprising a plurality of game pieces non-releasably rotatably engaged with the playing surface for use with the playing surface when playing the predetermined board game, the plurality of game pieces being stored with the playing surface in the hollow interior of the body in the closed configuration, each game piece having at least two different indicia thereon so that rotation of the game piece to a first orientation presents one indicium and rotation to a second orientation presents another indicium differing from the one indicium.

2. A toy play set for containing at least one predetermined board game, the toy play set comprising:

a generally circular cylindrically shaped, elongated body having a hollow interior, first and second opposing longitudinal ends, a central axis extending through the body between the longitudinal ends and a generally cylindrically shaped curved side wall extending around the hollow interior and the central axis elongatedly between the first and second ends, whereby the first and second ends and side wall generally surround the hollow interior in a closed configuration of the body, the generally cylindrically shaped curved side wall being generally circular in shape in planes perpendicular to the central axis, the body having an open configuration in which the hollow interior is at least partially accessible;

a playing surface operably engaged with the body to play the predetermined board game, the playing surface being shaped and sized to be completely stored within the hollow interior of the body with the body in the closed configuration, the playing surface being accessible at least with the body in the open configuration for playing of the predetermined board game; and a plurality of game pieces selected for use with the playing surface when playing the predetermined board game, the plurality of game pieces being sized to store with the playing surface in the hollow interior of the body in the closed configuration, the game pieces being non-releasably rotatably engaged with the playing surface.

3. The toy play set of claim 2, wherein each game piece has at least two different indicia thereon so that rotation of the game piece to a first orientation presents at least one indicium and rotation to a second orientation presents another indicium differing from the one indicium.

4. The toy play set of claim 2, wherein:

the body has a first portion and a second portion hinged together with the first portion, the playing surface includes a first side engaged with only the first portion of the first and second portions of the body and a second side engaged with only the second portion of the first and second portions of the body, and at least one of the first and second sides is slidable along the one body portion engaged with the at least one side in a linear direction toward the other of the first and second sides of the playing surface and simultaneously toward a hinged edge of the other of the first and second body portions engaged with the other of the first and second sides with the body in the open configuration.

5. The toy play set of claim 2, wherein the body has a first portion and a second portion hinged together with the first portion, and a generally planar first side of the playing surface is directly slidably engaged with only the first portion of the first and second portions of the body and a generally planar second side of the playing surface is directly slidably engaged with only the second portion of the first and second portions of the body.

6. The toy play set of claim 5, wherein the first and second portions of the body rotate with respect to each other about adjoining hinged edges to place the body in the open configuration, such that outer surfaces of the first and second portions form a bottom side of the play set and the first and second sides of the playing surface form a top side of the play set.

7. A toy play set comprising:

an elongated body having a hollow interior, first and second opposing longitudinal ends, and a generally curved side wall essentially defining an elongated body of revolution between the first and second ends and essentially surrounding the hollow interior with the first and second ends in a closed configuration of the body, the body being essentially bisected along a central plane extending longitudinally between the first and second ends of the body to define first and second portions, each portion forming substantially half of the body, the first and second portions being hinged together on one pair of adjoining side edges so as to be pivotable apart from one another and provide an open configuration of the body with access to the hollow interior;

a plurality of play pieces storable in the hollow interior with the body in the closed configuration and accessible to a user with the body in the open configuration; and a generally cup-shaped lid with an open end and an oppositely disposed closed end, the open end being removably engageable with at least one of the first and second ends in the closed configuration of the body and positionable in engagement with the side wall away from the first and second ends in the open configuration of the body.

8. The toy play set of claim 7 wherein the lid is slidably engaged with the sidewall with the lid removed from the first and second ends of the body.

9. The toy play set of claim 7 wherein the lid further is rotably engaged with the sidewall with the lid is removed from the first and second ends of the body.

10. The toy play set of claim 7 wherein the lid is slidably engaged the sidewall in both the open and closed configurations of the body.

11. The toy play set of claim 10 wherein the lid is slidably engaged with one of the first and second portions of the sidewall so as to be slidable along the sidewall on the one of the first and second portions of the sidewall in both the open and closed configurations of the body.

12. The toy play set of claim 10 further comprising a slider slidably engaged with the sidewall and pivotally engaged with the lid, the lid being slidably engaged to the sidewall through the slider.

13. The toy play set of claim 12 wherein the lid is further rotably engaged with the sidewall through the slider.

14. The toy play set of claim 7 wherein each of the plurality of game pieces is mechanically interlocked with the playing surface for rotation.

15. The toy play set of claim 7 wherein the playing surface is provided by a first side and a separate second side and wherein the first side of the playing surface is directly slidably engaged with only the first portion of the first and second portions of the body and wherein the second side of the playing surface is directly slidably engaged with only the second portion of the first and second portions of the body.

16. The toy play set of claim 15 wherein at least one of the first and second sides of the playing surface is linearly slidable in directions generally parallel to the plane of the at least one side in the open configuration of the body.

17. The toy play set of claim 15 wherein the first side of the playing surface is interconnected by direct mechanical engagement with only the first portion of the first and second portions of the body and wherein the second side of the playing surface is interconnected by direct mechanical engagement with only the second portion of the first and second portions of the body.

18. The toy play set of claim 7 wherein at least one of the first and second ends is circular.

* * * * *